US007473848B2

(12) United States Patent
Kenny et al.

(10) Patent No.: US 7,473,848 B2
(45) Date of Patent: Jan. 6, 2009

(54) CRUST RESISTANT TWISTED PAIR COMMUNICATIONS CABLE

(75) Inventors: Robert D. Kenny, Cincinnati, OH (US); John L. Netta, Newark, DE (US); Gary Thuot, Hockessin, DE (US); Sundar Kilnagar Venkataraman, Avondale, PA (US); Robert Thomas Young, Newark, DE (US)

(73) Assignee: E.I. duPont de Nemours and Company, Wilmington, DE (US)

( * ) Notice: Subject to any disclaimer, the term of this patent is extended or adjusted under 35 U.S.C. 154(b) by 0 days.

(21) Appl. No.: 12/100,433

(22) Filed: Apr. 10, 2008

(65) Prior Publication Data

US 2008/0264671 A1 Oct. 30, 2008

Related U.S. Application Data

(60) Provisional application No. 60/926,361, filed on Apr. 25, 2007.

(51) Int. Cl.
*H01B 7/00* (2006.01)

(52) U.S. Cl. ..... 174/110 R; 174/113 R; 174/120 R; 174/120 C

(58) Field of Classification Search ..... 174/110 R, 174/110 FC, 113 R, 120 R, 120 C, 112
See application file for complete search history.

(56) References Cited

U.S. PATENT DOCUMENTS

| | | | | |
|---|---|---|---|---|
| 2,556,224 | A * | 6/1951 | Scott | 174/29 |
| 3,085,083 | A | 4/1963 | Schreyer | |
| 4,029,868 | A | 6/1977 | Carlson | |
| 4,742,122 | A | 5/1988 | Buckmaster et al. | |
| 4,743,658 | A | 5/1988 | Imbalzano et al. | |
| 4,764,538 | A | 8/1988 | Buckmaster et al. | |
| 4,877,815 | A | 10/1989 | Buckmaster et al. | |
| 5,677,404 | A | 10/1997 | Blair | |
| 5,783,219 | A | 7/1998 | Milliman | |
| 5,932,847 | A * | 8/1999 | Mayfield | 174/113 R |
| RE37,010 | E * | 1/2001 | Newmoyer | 174/113 R |
| 6,194,663 | B1 * | 2/2001 | Friesen et al. | 174/110 R |
| 6,222,129 | B1 | 4/2001 | Siekierka et al. | |
| 6,534,715 | B1 * | 3/2003 | Maunder et al. | 174/110 R |
| 6,541,588 | B1 | 4/2003 | Kaulbach et al. | |

(Continued)

FOREIGN PATENT DOCUMENTS

GB 416865 9/1934

OTHER PUBLICATIONS

PCT International Search Report and Written Opinion for International Application No. PCT/US2008/005012 dated Aug. 29, 2008.

*Primary Examiner*—William H Mayo, III

(57) ABSTRACT

Communication cable is provided comprising a twisted pair of polymer insulated conductors, the twisting to form the twisted pair forcing the surface of polymer insulation of each polymer-insulated conductor of said polymer-insulated conductors into contact with one another, the polymer insulation of each polymer-insulated conductor including (i) a foamed portion being crushable by the forcing together of the contacting surfaces of the polymer insulation of each of the polymer-insulated conductors and (ii) a crush-resistant portion extending radially within said insulation into the foamed portion and being present where the surface of the polymer-insulated conductors are into said contact with one another, thereby protecting the foamed portion from crushing by the forcing together of the contacting surfaces.

14 Claims, 5 Drawing Sheets

U.S. PATENT DOCUMENTS 6,838,545 B2 1/2005 Chapman et al.
6,914,193 B2 * 7/2005 Ware et al. ..... 174/110 R
7,122,609 B2 10/2006 Earnest, Jr. et al.
7,204,896 B2 * 4/2007 Maunder et al. ..... 156/51
2005/0217891 A1 10/2005 Belli et al.

* cited by examiner

CRUST RESISTANT TWISTED PAIR COMMUNICATIONS CABLE

FIELD OF THE INVENTION

The present invention relates to twisted pair communications cable, and more particularly, to such cable wherein the polymer insulation of each polymer-insulated conductor is foamed.

BACKGROUND OF THE INVENTION

Twisted pair communications cable is used for high frequency signal transmission, typically in plenum areas of buildings. The cable is composed of twisted pairs of polymer-insulated conductors, covered by a polymer jacket. Usually the cable contains multiple twisted pairs separated from one another by a spline having a cruciform cross-section section, all being contained within a common polymerjacket. For flame retardency and smoke resistance, in case a building fire occurs, the polymer insulation is fluoropolymer. In the case of multiple twisted pairs within a single cable, a small number of the polymer insulations can be polyolefin, which by itself is both flammable and emits smoke when burning. The combination of fluoropolymer insulation as the predominating insulation, together with polyolefin insulation is acceptable under some building circumstances.

One requirement of the twisted pair polymer-insulated conductors is the transmission of electrical signals with little to no signal loss. One mechanism of signal loss is the absorption of signal energy by the polymer insulation. This absorption increases as the mass of the polymer insulation increases. Thus, it is common that thin insulation thicknesses are used, typically no greater than about 20 mils (500 μm), usually no greater than about 12 mils (300 μm). Foamed insulations have been used to reduce the mass of polymer in the insulation, and indeed this reduces the energy absorption (capacitance) of the polymer insulation. The problem with foamed insulations, however, has been that the foamed insulation is compressible by the twisting operation which combines (twins) two polymer-insulated conductors together. In the course of being twisted together, the surfaces of the polymer insulations are forced together. The magnitude of the force varies with twisting equipment and the tightness of the twist, i.e. number of turns per unit of length, e.g. /ft or /m. The result of this force compressing the surface of the foamed insulation is to decrease its thickness, resulting in decreased dielectric property (decreased impedance) between the two insulated conductors of the twisted pair at the location of insulation compression. To compensate for this undesirable loss in insulation thickness, the polymer-insulated wire manufacturer must increase the thickness of the foamed polymer insulation in the extrusion foaming process of applying the insulation to the conductor. This detracts from the advantage of using foamed insulation instead of solid (unfoamed) insulation and creates difficulties in fitting the foamed-insulated twisted pair cables into small spaces and prevents the utilization of existing connector sizes.

The problem is how to make the substitution of foamed insulation for solid insulation without creating the disadvantage of greater compressibility of the foamed insulation arising from the twisting process.

BRIEF SUMMARY OF THE INVENTION

The present invention solves this problem by providing a crush resistant foamed insulation. More particularly, the present invention is a twisted pair of polymer insulated conductors, the twisting process forming the twisted pair of insulated conductors forcing the exposed surfaces of the polymer insulation of each polymer-insulated conductor of the polymer-insulated conductors into contact with one another. According to the present invention, the polymer insulation of each of polymer-insulated conductor includes (i) a foamed polymer portion being crushable by this forcing of the surface of said polymer insulation of said polymer-insulated conductors into contact with one another and (ii) a crush-resistant polymer portion extending radially within said insulation into the foamed portion and being present where the exposed surface of the polymer-insulated conductors are in contact with one another. The presence of the portion (ii) where the exposed surface of each polymer insulation is being forced together resists compression thereby protecting the foamed portion from crushing resulting from the forcing of these exposed surfaces of said polymer insulation of said polymer-insulated conductors into contact with one another. In one embodiment, the crush-resistant portion (ii) extends radially within the insulation from the outer surface of the insulation, towards or to the conductor.

Thus, the present invention provides a polymer insulation which is the combination of foamed and unfoamed polymer, the unfoamed polymer being disposed within the polymer insulation to prevent the foamed portion from being crushed by the force exerted against the surface of the polymer insulation by the operation of twisting a pair of insulated conductors together. The twisting operation is commonly referred to as twinning. The presence of the portion (ii) where the surface of the two insulated conductors are forced into contact with one another, together with the extension of the portion (ii) into the thickness of the portion (i) provides the crush resistance to the polymer insulation. The shape of the portion (ii) extending into the foamed portion of the insulation also contributes to the crush resistance imparted by portion (ii) to the polymer insulation as will be discussed further hereinafter. The twinning force can be so great that even solid polymer insulation is deformed at the intersection of the polymer insulations, but the resistance to deformation of solid polymer insulation is much greater than the resistance to deformation (crush resistance) of foamed insulation. Consequently, even the portion (ii) can be deformed a relatively small amount when the twinning force is great enough. Preferably, the crush resistance of the crush-resistant portion is such that the width of two diameters in said twisted pair is at least about 90% of the sum of the diameters of each of the polymer-insulated conductors prior to said twisting.

While the portion (ii) of the polymer insulation obtains its crush resistance by being unfoamed, and while the unfoamed portion of the polymer insulation would seem to add to the capacitance of the overall polymer insulation, this added polymer mass to the insulation is compensated for by the ability to utilize foaming conditions for the portion (i) of the insulation that increase void content, thereby using less polymer mass in the unfoamed portion. Thus, the present invention can reduce the capacitance of the insulation, thereby increasing signal transmission velocity.

In a preferred embodiment, the polymer insulation portions (i) and (ii) are each subdivided into at least three regions alternating with respect to one another, each extending radially into the insulation and each extending along the length of each said polymer-insulated conductors. These regions are preferably symmetrical about the conductor when viewed in cross section of the insulated conductor. The presence of multiple regions of portion (ii) enhances the likelihood of these regions being present where the surfaces of the insulated conductors in the twisted pair are in contact with one another, without making special provisions in the twinning operation.

The importance of crush-resistant foamed polymer insulation is increasing as the desire to have tighter twists increases to counteract the possibility of adjacent twisted pairs in a cable nesting together. Nesting promotes crosstalk between the adjacent twisted pairs.

BRIEF DESCRIPTION OF THE DRAWING(S)

DETAILED DESCRIPTION OF THE INVENTION

Figure 1:
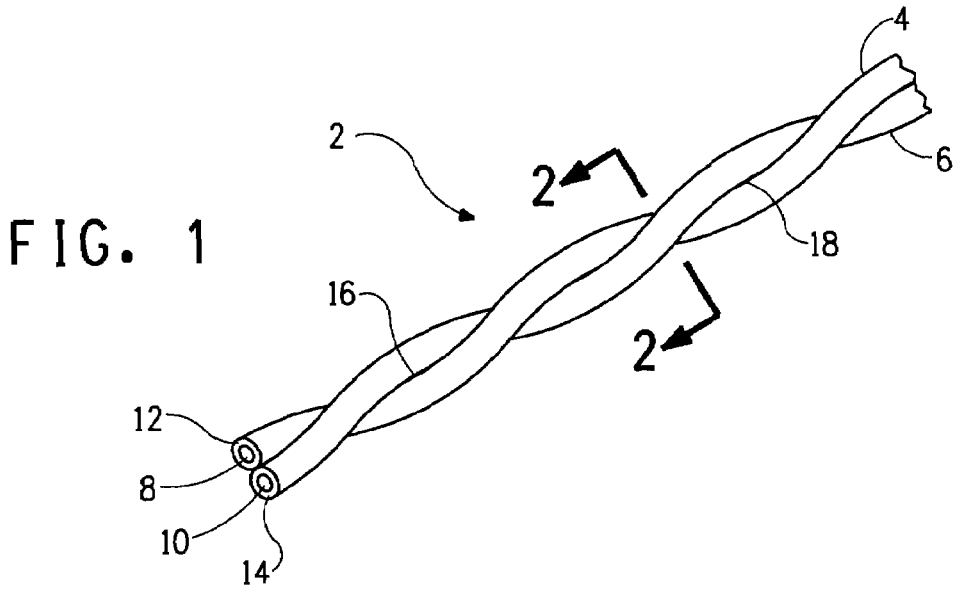
FIG. 1 is an enlarged isometric view of a twisted pair of polymer-insulated conductors of the present invention, without showing the detail of the constitution of the polymer insulation.

FIG. 1 shows a twisted pair 2 of polymer-insulated conductors 4 and 6, each consisting of a central conductor 8 and 10, respectively, such as of copper, and polymer insulation 12 and 14, respectively. The twinning process to form the twisted pair 2 is a conventional operation, causing the exposed surfaces of insulation 12 and 14 to be forced together such as at contact points 16 and 18. The contact points 16 and 18 will generally be parts of a helical contact line or area tracing the sinusoidal contact between the two insulated conductors. Continuity of the contact line is preferred for impedance uniformity between the insulated conductors of the twisted pair. The force that would cause crushing of the foamed insulation, if the insulation were entirely foamed, arises from the twinning operation and remains present in the twisted pair of insulated conductors. The crush-resistant portion of the polymer insulation protects the foamable portion.

Figure 2:
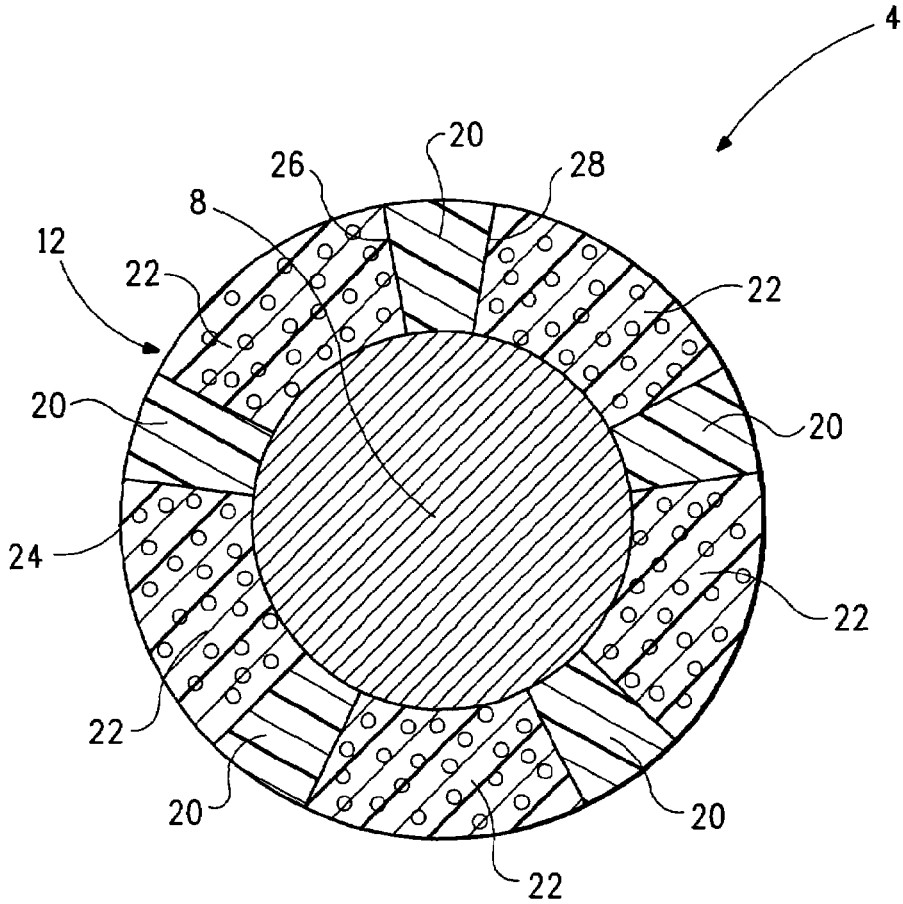
FIG. 2 is an enlarged cross-section of one of the insulated conductors of the twisted pair of insulated conductors of FIG. 1 along section 2-2, showing detail of one embodiment of cross-section of the polymer insulation of the present invention.

FIG. 2 shows a cross-section of insulated conductor 4 comprising conductor 8 and insulation 12, wherein the crush resistant portion is subdivided into five unfoamed regions 20 alternating with five foamed regions 22. The regions 20 obtain their crush resistance by being essentially unfoamed. In the embodiment shown, the regions 20 extend radially through the entire thickness of the foamed insulation regions 22, to rest upon conductor 8, whereby the force of twinning applied against the exposed surface 24 of the insulation is supported by the conductor 8 to add to the crush resistance of the regions 20. Preferably, the unfoamed regions extend through at least 40% of thickness of the insulation, more preferably at least 60%, measured from the outer surface of the polymer insulation. This itself provides crush resistance even though foam structure may underlie the regions 20 by virtue of the inwardly tapering cross-section of these regions as the regions extend radially into the thickness of the foamed regions 22. In this regard the regions 20 resemble a trapezoid. The sides 26 and 28 of this trapezoidal shape (cross-section) of the regions 20 are supported by the contacting foam regions 22. The regions are preferably symmetrical about the central conductor 8. Preferably, the symmetrical distribution of these regions includes the foamed regions being of uniform size with respect to one another and the crush resistant regions being of uniform size with respect to one another and the foamed regions and crush-resistant regions being uniformly distributed (spaced) within the insulation cross-section.

Figure 3:
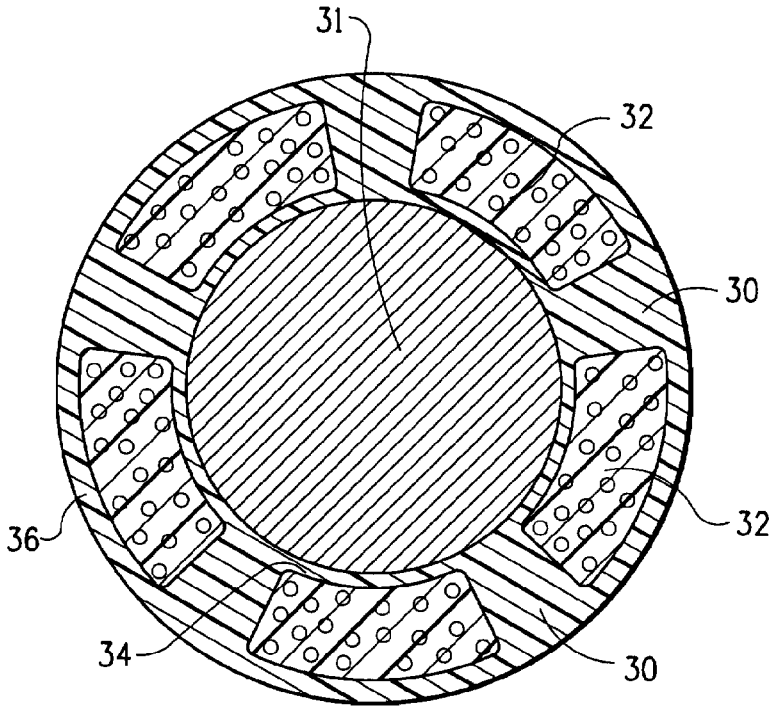
FIG. 3 shows another embodiment of enlarged cross-section of insulation of one polymer-insulated conductor of the twisted pair.

In FIG. 3, the crush-resistant regions 30 and foam regions 32 are alternating with respect to one another and are symmetrical about the conductor 31. In this embodiment, a layer 34 is present at the innermost surface of the insulation, i.e. contacting the conductor, this layer being essentially unfoamed. In this regard, the composition of this layer is the same as the composition of the foamed regions 32, including the presence of foam cell nucleating agent, but the extrusion process conditions are such that foaming in the region adjacent to the conductor occurs very little if at all, i.e. the layer 34 is essentially unfoamed. This process condition includes having the conductor be relatively "cold" at the time the foamable polymer composition forming the foamed regions 32 comes into contact with the conductor, whereby this conductor adjacent region cools faster than the bubbles (foam cells) in the molten polymer can form, resulting in foam structure differentiation between this region and the foamed region. The resulting layer 34 generally has a void content of less than about 10%, preferably less than about 5%, and exhibits some visual distinctness from the foamed region, which generally has a void content of at least about 20%, preferably at least 30%.

In the embodiment of FIG. 3, the crush-resistant regions 30 extend into layer 34, and an essentially unfoamed layer 36 is also present at the outer (exposed) surface of the polymer insulation. The layers 34 and 36 interconnect the regions 30, adding to the crush resistance of the overall polymer insulation. As in the case of layer 34, layer 36 is also essentially unfoamed. Some foamable composition may penetrate the extruded polymer forming layer 36 polymer to create some bubble formation. The condition of layer 36 being essentially unfoamed, can be characterized the same as for layer 34 described above, in view of the irregularity at the interface between layer 36 and the adjacent foamed regions. Nevertheless, when layers 34 and/or 36 are present, it preferred that they each constitute at least about 10% of the overall thickness of the polymer insulation.

Figure 4:
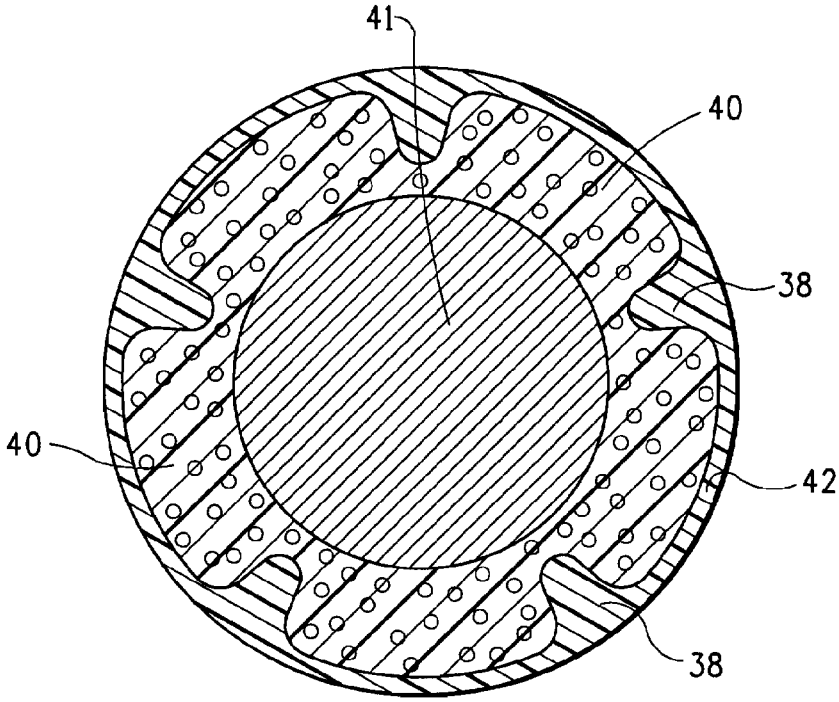
FIG. 4 shows still another embodiment of enlarged cross-section of insulation of one polymer-insulated conductor of the twisted pair.

The embodiment of FIG. 4 differs from that of FIG. 3, by the crush-resistant regions 38 extending into the foamed region 40, but only into about 60% into the overall thickness of the polymer insulation, measured from the outer surface of the polymer insulation. As in the embodiment of FIG. 3, an exposed surface layer 42 is present interconnecting the regions 38, but the region adjacent to the surface of conductor 41 is much more foamed than layer 34 in FIG. 3. Nevertheless, this embodiment still exhibits significant crush resistance as compared to insulation composed entirely of the foamed composition having the same void content as the foamed region alternating between the crush-resistant regions and extending beneath them as shown in FIG. 4.

Figure 5:
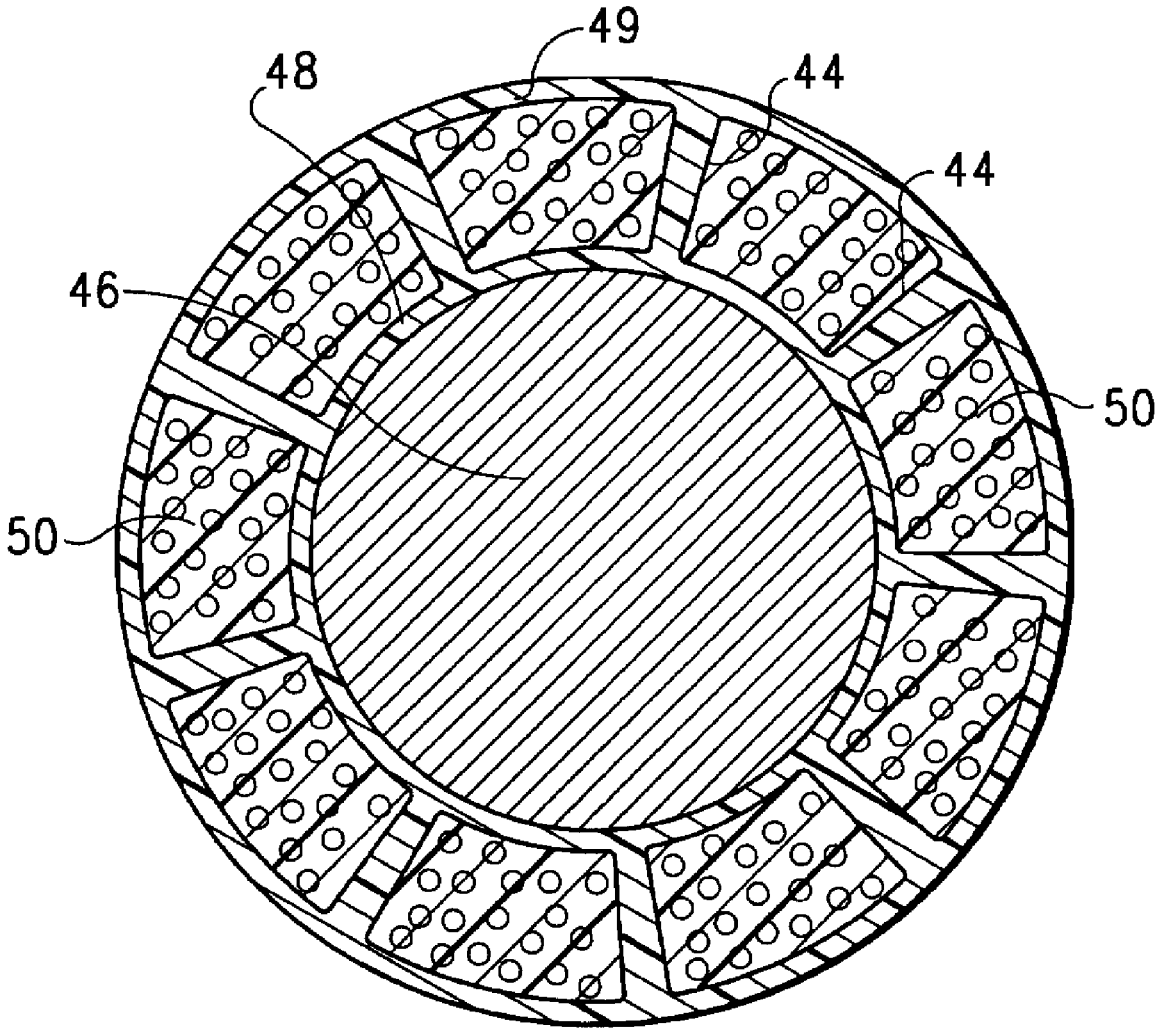
FIG. 5 shows still another embodiment of enlarged cross-section of one insulated conductor of the twisted pair of insulated conductors

In the embodiment of FIG. 5, the cross-sectional structure of the foam/crush-resistant portion (spline) insulation construction comprises nine splines 44 symmetrically arrayed about conductor 46 and interconnected by unfoamed layers 48 and 49 at the surface of the conductor and the surface of the insulation, respectively. The splines alternate with foamed regions 50.

In all the embodiments of polymer insulation shown in FIGS. 2-5, the structure forming the subdivided, alternating regions of polymer insulation, i.e. the crush-resistant regions and foamed regions, extend continuously along the length of the conductor. These regions also complement each other and can constitute the entire thickness of the polymer insulation. While the cross-sectional representations of the insulation structures of FIGS. 3 and 4 depict the crush-resistant regions as arms of trapezoidal shapes, extending radially into the foamed regions, sometimes entirely, sometimes partially, they are in fact splines running the length of the insulated conductor, wherein the foamed regions fill in the spaces between, and possibly under, such splines. From FIG. 1, it can be seen that the insulated conductors of the twisted pair cross-over one another, whereby the splines become present at the contact between the exposed surface of the polymer insulations. The width and frequency of the splines, together with the outer essentially unfoamed layer, provide the crush-resistant interface between the contacting polymer insulations. The width of the unfoamed splines is preferably minimized consistent with the crush resistance desired, so as to minimize the amount of polymer present in the insulation, thereby minimizing its capacitance. Preferably the area of the unfoamed region in the cross section of the insulation is no greater than about 50% of the total of the cross sectional area, more preferably no greater than about 40%. Because of the continuous contact of the twisted insulated conductors with one another, there is a possibility that some points of contact will not be spline-spline, but will be spline to outer unfoamed layer, e.g. unfoamed layer 36 of FIG. 3, or foamed insulation, e.g. foamed region 22 of FIG. 2, in which case the loss in the sum of the diameters on the twist pair will be about one-half of that if no crush-resistant regions were present. In any event, adjacent spline-to-spline contacts tend to support (limit crushing of) their respective foamed insulation regions if these become contact points between the polymer insulations of the twisted pair. Such crushing will proceed only until one insulated conductor contacts adjacent splines present in the insulation of the other insulated conductor of the twisted pair. The probability for spline-to-spline contact can be increased by increasing the number and/or the width of the splines. Therefore, preferably, there are at least five crush-resistant regions, more preferably at least seven crush-resistant regions, and still more preferably, at least nine crush-resistant regions present in the polymer insulation. These crush-resistant regions are preferably of approximately equal cross-sectional area, preferably alternating symmetrically with the foamed regions. For each of these number of splines, the penetration (radial extension) of the splines into the thickness of the insulation can be as described above. Similarly, a surface layer of essentially unfoamed polymer can be located within the insulation at the surface adjacent the conductor or at the exposed (outer) surface of the insulation or at both locations and their thickness can be as described above.

Figure 6:
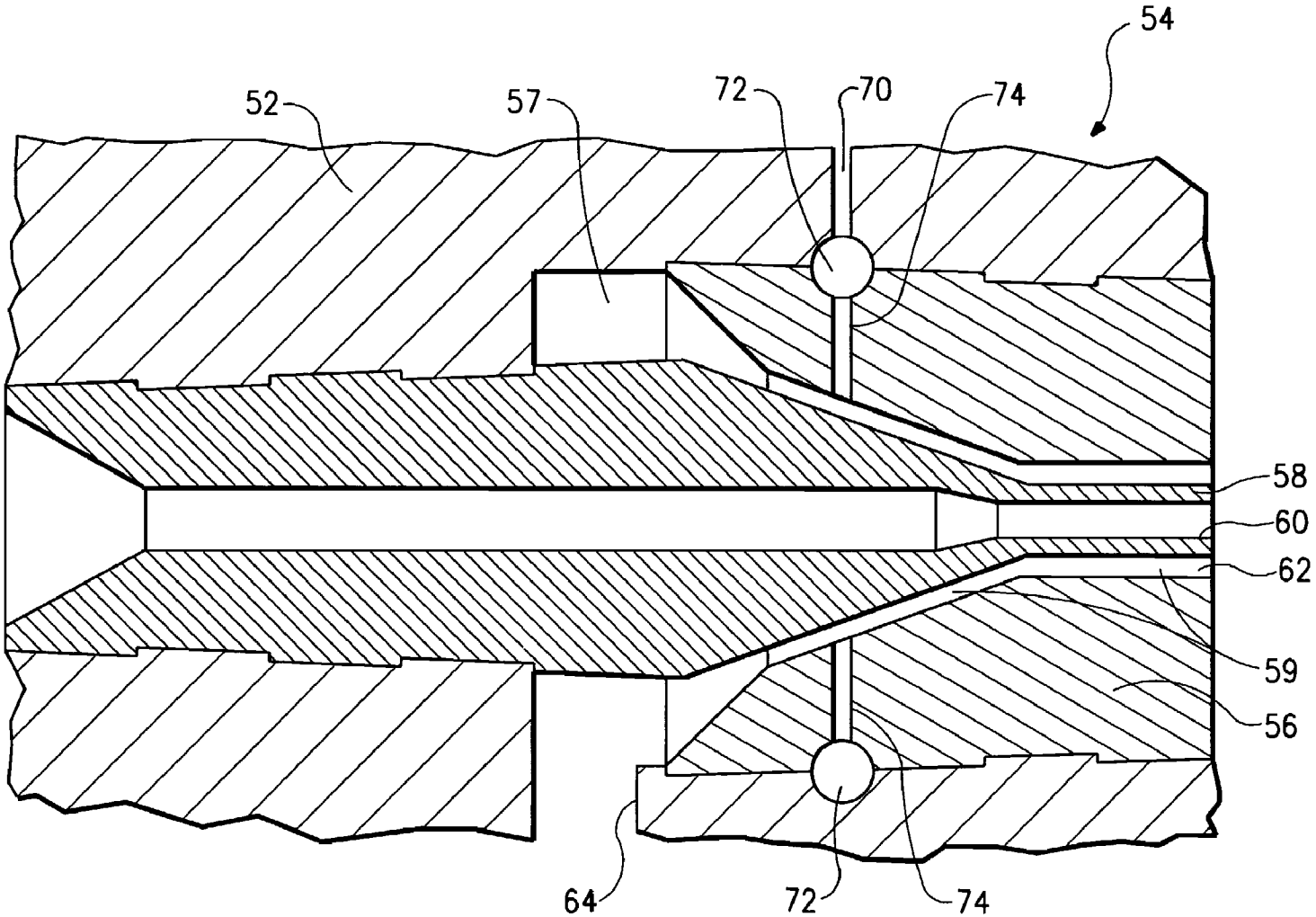
FIG. 6 shows in cross-section a fragmentary cross-sectional view of one embodiment of extruder cross-head for obtaining polymer insulation used in the present invention.

FIG. 6 shows one embodiment of a fragmentary view of the extruder crosshead design 54 that can obtain the insulation structures of FIGS. 2, 3, and 5. Concentrically fitted within the body 52 of the cross-head 54, are the die 56 and die tip 58. Molten polymer composition, pressurized (injected) with inert gas, is fed into the die by a port 64 from an extruder (not shown) and the crosshead body 52 contains a circumferential channel 57, with respect to the die tip 58, enabling this molten polymer composition to flow entirely around the die tip and into and though the narrowed annular gap 59 between the die 56 and die tip 58. The die tip 58 has an axial wire (conductor) guide 60, and the annular orifice 62 between the die 56 and die tip 58 defines the extruded dimension of tubular shape of molten polymer composition that is drawn down by a vacuum, imposed through the wire guide 60, onto the wire to form the polymer insulation. The foaming of the foamable portion of the molten polymer insulation is delayed until the polymer composition is drawn down onto the wire, whereupon the foaming occurs and the thus-insulated wire is cooled to freeze the foam construction.

The foregoing description of the crosshead and extrusion process are conventional. Structure and conditions which enable the practice of the present invention are presented hereinafter. The crush-resistant regions of the polymer insulation are obtained by injecting molten polymer though a port 70 from a side extruder (not shown). This molten polymer has not been pressurized with inert gas, whereby this molten polymer is non-foamable. An annular channel 72 is formed between the crosshead body 52 and die 56, enabling the molten polymer to encircle the die 56. A plurality of additional ports 74 are provided in the die, to communicate between the channel 72 and annular gap 59. The number and radial distribution of additional ports 74 correspond to the number and radial distribution of crush-resistant regions (splines) to be formed in the polymer insulation. The molten polymer flowing through these additional ports forms the crush-resistant regions of the polymer insulation. In operation, molten foamable polymer composition is flowed (forced) along the annular gap 59 and molten polymer is flowed (forced) through the additional ports 74 to penetrate and possibly subdivide the flow of molten foamable polymer composition. The molten polymer flowing through the additional ports 74 is not intended for foaming. The penetrating disposition of the molten polymer from the additional ports 74 into the foamable molten polymer composition fed into the annular gap 59 is maintained during the travel through the annular orifice 62 and through draw down onto the wire to form the foamed crush-resistant polymer insulation on the wire. The degree of penetration of the molten polymer from the additional ports is controlled by the relative flow rates of polymer and polymer composition through port 70 and port 64, respectively. The formation of the trapezoidal cross-sectional shape of the crush-resistant regions occurs naturally. The formation of an essentially unfoamed layer such as layer 34 (FIG. 3) on the surface of the conductor is accomplished by having the wire passing through die tip 58 chill the foamable polymer composition prior to it being able to foam as a result of the release of pressure on the molten polymer composition accompanying its extrusion from annular orifice 62. To accomplish this chilling, the wire is heated but to a relatively low temperature, preferably no greater than about 240° F. (116° C.).

Figure 7:
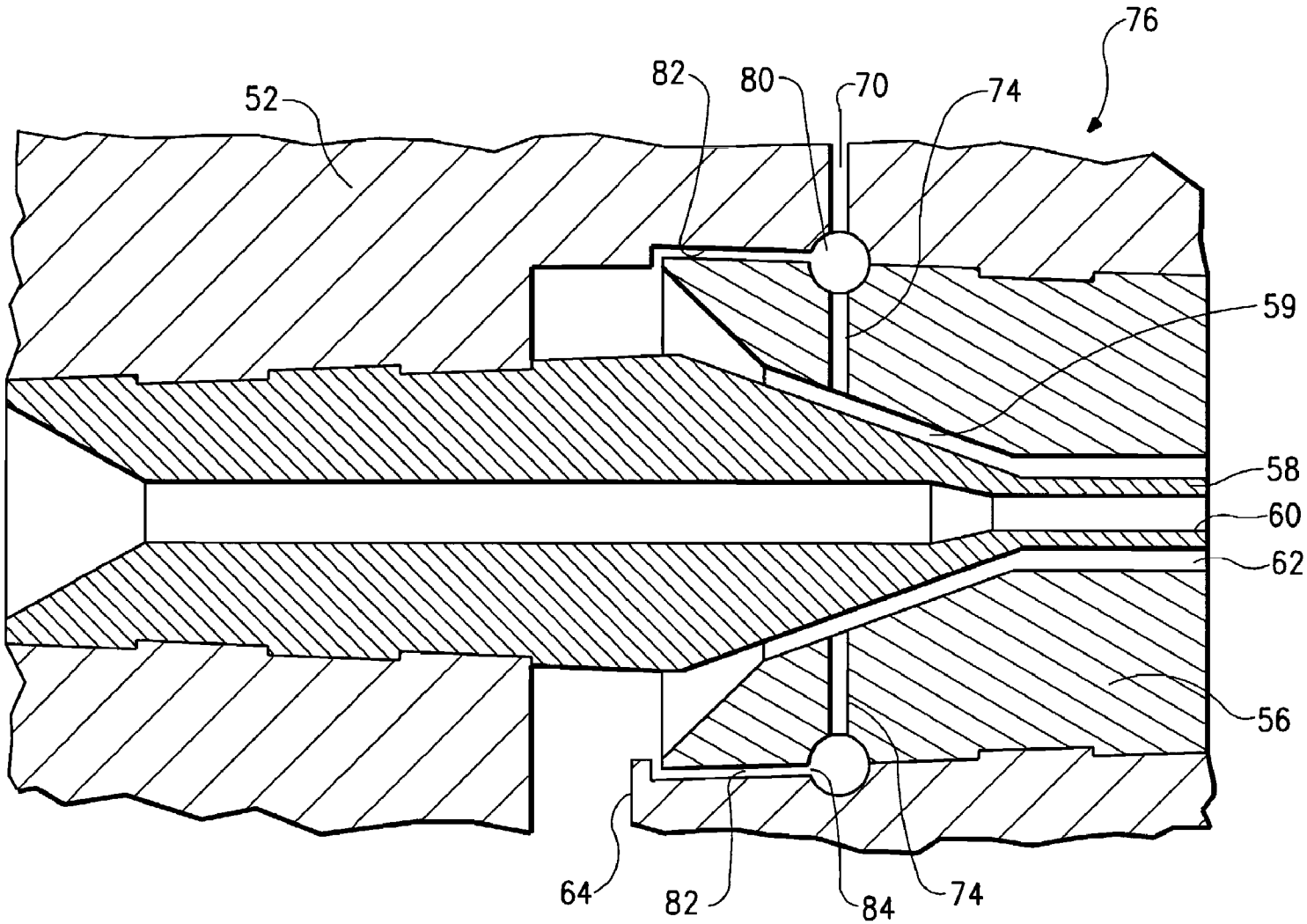
FIG. 7 shows in cross-section a fragmentary cross-sectional view of another embodiment of extruder cross-head for obtaining polymer insulation used in the present invention.

The crosshead 76 of FIG. 7 consists of the same elements as in FIG. 6 except that it is modified to produce the essentially unfoamed layer 49 of FIG. 5 interconnecting the crush-resistant regions at the outer surface of the polymer insulation. In this regard, the crosshead body is modified to form an annular gap 82 surrounding the die 56 and the annular channel 80 includes an annular opening 84. This modification enables the molten polymer flowing through port 70 to flow both into the additional ports 74, but also into the annular gap 82, the latter enabling the molten polymer to enter the annular gap 59 upstream from the additional ports 74. This upstream entry penetrates the flowing molten foamable polymer composition sufficiently to form the surface layer, which is in turn penetrated by the molten polymer flowing from the additional ports 74 to form the crush-resistant regions. The thickness of the surface layer, such as layer 36 of FIG. 3 is controlled by the relative flow rates of the molten polymer flowing through port 70 and the molten foamable polymer composition flowing through port 64, i.e. sufficient molten polymer is supplied through port 70 to supply the polymer for the unfoamed outer insulation layer in the thickness desired and the splines to the degree of penetration desired. Thus, the splines can reach the conductor as shown in FIG. 2 or can reach the inner unfoamed layer 34 (FIG. 3) or 48 (FIG. 5). FIGS. 3 and 5 show these layers 34 and 48, respectively, as being unitary with respect to their respective splines, when in fact the interconnection between these inner layers and their respective splines may be a contact line or weld line between the layer and spline, nevertheless providing a solid support for the splines. Preferably the crush-resistant regions extend essentially entirely through the thickness of the insulation so as at least be supported by solid material, which is the conductor 8 in FIG. 2 or the inner unfoamed layers 34 and 48 of FIGS. 3 and 5, respectively. The unfoamed surface layer may also be obtained by using the die design disclosed in U.S. Pat. No. 5,783,219.

The fluoropolymer used in the present invention is preferably a copolymer of tetrafluoroethylene (TFE) and hexafluoropropylene (HFP). In these copolymers, the HFP content is typically about 6-17 wt %, preferably 9-17 wt % (calculated from HFPI×3.2). HFPI (HFP Index) is the ratio of infrared radiation (IR) absorbances at specified IR wavelengths as disclosed in U.S. Statutory Invention Registration H130. Preferably, the TFE/HFP copolymer includes a small amount of additional comonomer to improve properties. The preferred TFE/HFP copolymer is TFE/HFP/perfluoro(alkyl vinyl ether) (PAVE), wherein the alkyl group contains 1 to 4 carbon atoms. Preferred PAVE monomers are perfluoro(ethyl vinyl ether) (PEVE) and perfluoro(propyl vinyl ether) (PPVE). Preferred TFE/HFP copolymers containing the additional comonomer have an HFP content of about 6-17 wt %, preferably 9-17 wt % and PAVE content, preferably PEVE, of about 0.2 to 3 wt %, with the remainder of the copolymer being TFE to total 100 wt % of the copolymer. Examples of FEP compositions are those disclosed in U.S. Pat. Nos. 4,029,868 (Carlson), 5,677,404 (Blair), and 6,541,588 (Kaulbach et al.) and in U.S. Statutory Invention Registration H130. The FEP is partially crystalline, that is, it is not an elastomer. By partially crystalline is meant that the polymers have some crystallinity and are characterized by a detectable melting point measured according to ASTM D 3418, and a melting endotherm of at least about 3 J/g.

Other fluoropolymers can be used, i.e. polymers containing at least 35 wt % fluorine, that are melt fabricable so as to be melt extrudable, but FEP is preferred because of its high speed extrudability and relatively low cost. In particular applications, ethylene/tetrafluoroethylene (ETFE) polymers will be suitable, but perfluoropolymers are preferred, these including copolymers of tetrafluoroethylene (TFE) and perfluoro(alkyl vinyl ether) (PAVE), commonly known as PFA, and in certain cases MFA. PAVE monomers include perfluoro(ethyl vinyl ether) (PEVE), perfluoro(methyl vinyl ether) (PMVE), and perfluoro(propyl vinyl ether) (PPVE). TFE/PEVE and TFE/PPVE are preferred PFAs. MFA is TFE/PPVE/PMVE copolymer. However, as stated above, FEP is the most preferred polymer.

The fluoropolymers used in the present invention are also melt-fabricable, i.e. the polymer is sufficiently flowable in the molten state that it can be fabricated by melt processing such as extrusion, to produce wire insulation having sufficient strength so as to be useful. The melt flow rate (MFR) of the perfluoropolymers used in the present invention is preferably in the range of about 5 g/10 min to about 50 g/10, preferably at least 20 g/10 min, and more preferably at least 25 g/10 min.

MFR is typically controlled by varying initiator feed during polymerization as disclosed in U.S. Pat. No. 7,122,609 (Chapman). The higher the initiator concentration in the polymerization medium for given polymerization conditions and copolymer composition, the lower the molecular weight, and the higher the MFR. MFR may also be controlled by use of chain transfer agents (CTA). MFR is measured according to ASTM D-1238 using a 5 kg weight on the molten polymer and at the melt temperature of 372° C. as set forth in ASTM D 2116-91a (for FEP), ASTM D 3307-93 (PFA), and ASTM D 3159-91a (for ETFE).

Fluoropolymers made by aqueous polymerization as-polymerized contain at least about 400 end groups per $10^6$ carbon atoms. Most of these end groups are unstable in the sense that when exposed to heat, such as encountered during extrusion, they undergo chemical reaction such as decomposition, either discoloring the extruded polymer or filling it with non-uniform bubbles or both. Examples of these unstable end groups include —COF, —$CONH_2$, —COOH, —CF=$CF_2$ and/or —$CH_2OH$ and are determined by such polymerization aspects as choice of polymerization medium, initiator, chain transfer agent, if any, buffer if any. Preferably, the fluoropolymer is stabilized to replace substantially all of the unstable end groups by stable end groups. The preferred methods of stabilization are exposure of the fluoropolymer to steam or fluorine, the latter being applicable to perfloropolymers), at high temperature. Exposure of the fluoropolymer to steam is disclosed in U.S. Pat. No. 3,085,083 (Schreyer). Exposure of the fluoropolymer to fluorine is disclosed in U.S. Pat. No. 4,742,122 (Buckmaster et al.) and U.S. Pat. No. 4,743,658 (Imbalzano et al.). These processes can be used in the present invention. The analysis of end groups is described in these patents. The presence of the —$CF_3$ stable end group (the product of fluorination) is deduced from the absence of unstable end groups existing after the fluorine treatment, and this is the preferred stable end group, providing reduced dissipation factor as compared to the —$CF_2H$ end group stabilized (the product of steam treatment) fluoropolymer. Preferably, the total number of unstable end groups constitute no more than about 80 such end groups per $10^6$ carbon atoms, preferably no more than about 40 such end groups per $10^6$ carbon atoms, and most preferably, no greater than about 20 such end groups per $10^6$ carbon atoms.

The fluoropolymer present in the crush-resistant regions and the foam regions are preferably similar enough that they are compatible, in the sense that the regions are inseparable during normal usage of the twisted pair of insulated conductors, and can be identical.

Polyolefins may also be used as insulation according to the present invention. Examples of polyolefins include polypropylene, e.g. isotactic polypropylene, linear polyethylenes such as high density polyethylenes (HDPE), linear low density polyethylenes (LLDPE), e.g. having a specific gravity of 0.89 to 0.92. The linear low density polyethylenes made by the INSITE® catalyst technology of Dow Chemical Company and the EXACT® polyethylenes available from Exxon Chemical Company can be used in the present invention; these resins are generically called (mLLDPE). These linear low density polyethylenes are copolymers of ethylene with small proportions of higher alpha monoolefins, e.g. containing 4 to 8 carbon atoms, typically butene or octene. Any of these thermoplastic polymers can be a single polymer or a blend of polymers. Thus, the EXACT® polyethylenes are often a blend of polyethylenes of different molecular weights.

The overall thickness of the polymer insulation including any outer surface and inner surface essentially unfoamed layers, such as layers 34 and 36 of FIG. 3, if present is generally from about 4 to 20 mils (100 to 500 μm), preferably about 6 to 14 mils (150-350 μm). This thickness is established by the annular orifice such as orifice 52 of FIG. 5, together with the draw down ratio and the void content of the foamed region. Any method for foaming the polymer to form the foamed regions of the polymer insulation can be used. It is preferred, however, that the method used will obtain cells (voids) that are both small and uniform for the best combination of electrical properties, such as low return loss and high signal transmission velocity. In this regard, the cells are preferably about 50 micrometers in diameter and smaller and the void content is about 10 to 70%, preferably about 20 to 50%, more preferably about 20 to 35%. Void content is determined by capacitance measurement on the insulated conductor as will be described under the Examples. This is the average void content of the foamed and unfoamed portions of the insulation. The preferred method for obtaining this foam result in the foamed regions of the insulation is the use of high pressure inert gas injection into the molten polymer in the extruder feeding through port 64 (FIG. 5) and having the molten polymer contain foam cell nucleating agent, which initiates the formation of small uniform size cells when foaming occurs downstream from the extrusion die. The foaming caused by the high pressure inert gas injection delays itself long enough for the extruded tube of polymer composition to be drawn down onto the conductor before foaming begins.

As the proportion of unfoamed crush-resistant regions, and unfoamed inner and outer layers is varied to obtain the crush-resistant result desired, the void content of the foamed regions can be varied by varying the pressure of the inert gas injected into the molten polymer to provide an unvarying capacitance of the polymer insulation. Thus, as the proportion of unfoamed polymer in the insulation is increased, the void content is also increased to provide about the same capacitance as the foamed/unfoamed insulation construction before changing the insulation construction by increasing the proportion of unfoamed polymer.

Preferably, the foam cell nucleating agent added to the polymer used in the present invention is thermally stable under extruder processing conditions. Examples of such agents include those disclosed in U.S. Pat. No. 4,877,815 (Buckmaster et al.), namely thermally stable organic acids and salts of sulfonic acid or phosphonic acid, preferably in combination with boron nitride and a thermally stable inorganic salt disclosed in U.S. Pat. No. 4,764,538. The preferred organic acid or salt has the formula $F(CF_2)_nCH_2CH_2$-sulfonic or phosphonic acid or salt, wherein n is 6, 8, 10, or 12 or a mixture thereof.

The essentially unfoamed layer, such as layer 48 of FIG. 5 is of the same composition as the foamed region, but avoids foaming by the chilling effect of contact with the conductor. The splines, such as crush resistant regions 44, and the outer layer 49 of FIG. 5 are both essentially unfoamed but for a different reason. The polymer forming these regions is injected into the molten polymer forming the foamable region of the insulation downstream of the high pressure inert gas injection, whereby this causation for foaming is not present in the polymer flowing through port 70. A small number foam cells may be formed in any of the essentially unfoamed regions, however, merely by penetration of foamable composition into these regions. Moreover, the line of demarcation between foamed and unfoamed region may be less than sharp, i.e. somewhat irregular, on the microscopic scale needed to view the voids (cells) within the foamed region.

While the crush-resistant regions and foamed regions forming the insulation extend along the length of the insulated conductor as a result of the extrusion foaming process forming the insulation, the longitudinal disposition of these regions is also in the form of a long-lay helix, i.e. the rotation motion imparted by the extruder screws to the molten polymer forming these regions causes the formation of a long-lay helix, wherein one rotation of the helix may occur at least every meter of length of the insulated conductor. Another attribute of the extrusion foaming process is that as the diameter of the foamed region increases during foaming after application to the conductor, the diameter of the unfoamed regions also corresponding expands. Surprisingly, especially when the crush-resistant regions (splines) extend through the thickness of the insulation, the force of foaming expansion of the foamed region also causes the splines to correspond extend radially, so that the polymer insulation has substantially a uniform diameter, i.e. remains substantially circular in cross section. If an outer layer is present interconnecting the splines, this outer layer stretches to accommodate the greater diameter of the polymer insulation after foaming than when the polymer extrudate first contacts the conductor, notwithstanding the fact that the surface of the polymer insulation is cooling.

The twisted pair of polymer insulated conductors of the present invention can be used in the same manner as existing twisted pairs, i.e. combined with other twisted pairs, preferably also of the present invention, to make the communications cable desired. Notably, the twisted pairs of the present invention provide thinner (smaller diameter) polymer insulated wires than solid polymer insulation, enabling the twisted pairs of the present invention to downsize cables required for such high performance as transmission at 10 GB/s signal frequency. This downsizing enables this high performance to be satisfied without change in installation connectors and carriers.

EXAMPLES

The crush resistance of the polymer insulated conductors is determined by the procedure of UL-444, which involves the crushing of a length of insulated conductor between opposed platens, measuring 5 mm square at a rate of 5 mm/min, each platen being electrically connected to the conductor of the insulated conductor being tested. Failure of the insulation, indicated by an electrical circuit being established between the conductor and one or both of the platens, is the peak load before short circuit, or simply peak load. Preferably the peak load provided by an insulated conductor, preferably both insulated conductors of a twisted pair, of the present invention is at least about 10% greater, and preferably at least about 20% greater than the peak load for the corresponding insulated conductor wherein the insulation is foamed and has no crush resistant regions. If an outer surface layer of unfoamed fluoropolymer is present, e.g. having a thickness up to about 1 mil (25 μm), this is not considered to be a crush-resistant region. By corresponding insulated conductor is meant that the dimensions (insulation thickness and conductor diameter) and capacitance are the same and the fluoropolymer is the same. Another measure of crush resistance is the resistance to initial deformation of the insulation as occurs in the twinning operation. This crush resistance is determined by recordation of the curve of displacement (reduction in overall diameter of the polymer insulation) with increasing load and determination of the slope of this curve in the region of 1 to 4 mils (25 to 100 μm) displacement (deformation). This amount of displacement corresponds to the crushing of the polymer insulation to 80% of its original thickness, based on the insulation thickness used in the Comparative Example and Examples being 10 mils (250 μm). The slope of the curve is the crush modulus for the polymer insulation. Preferably, the crush modulus of the insulated conductor, preferably each insulated conductor of the twisted pair is at least about 10% greater and more preferably at least about 20% greater than the crush modulus of the corresponding insulated conductor. The peak load and crush modulus characteristics of insulated conductor is determined as the mean value of three measurements. No effort is made to orient the insulation with respect to the platens. It has been found that especially the crush modulus measurements vary only slightly over the three measurements.

The capacitance of polymer insulated wire is commonly measured on the wire insulation extrusion line. From this measurement, the void content is determined from the following relationships:

$$\text{Capacitance}=7.354K/\log_{10}(D/d)$$

Wherein K is dielectric constant of the polymer insulation, D is the diameter of the polymer insulated conductor, and d is the diameter of the conductor. With the measurement of capacitance in pF/ft inserted into this equation, the value of K is determined. K is related to void content as shown in the Table 1.

TABLE 1

| Dielectric Constant | % Void Content |
|---|---|
| 2.1 | 0 |
| 2.0 | 6 |
| 1.9 | 13 |
| 1.8 | 21 |
| 1.7 | 28 |
| 1.6 | 36 |
| 1.5 | 45 |
| 1.4 | 55 |
| 1.3 | 66 |
| 1.2 | 78 |
| 1.1 | 88 |
| 1.0 | 100 |

From the calculation of dielectric constant (K) in the capacitance equation, the average void content of the insulation as a whole can be determined by interpolation of the void contents listed above. The actual void content of the foamed regions of the insulation is determined by measuring the cross-sectional area of the foamed regions of the insulation as a percentage of the total area of the insulation, and dividing this percentage in to the void content of the insulation as a whole. This table is applicable to the perfluoropolymers in general. For other fluoropolymers and the polyolefins, the relationship between dielectric constant and void content can be determined experimentally.

The fluoropolymer used in these Examples is a commercially available (from DuPont) fluoropolymer containing 10 to 11 wt % HFP and 1-1.5 wt % PEVE, the remainder being TFE. This FEP has an MFR 30 g/10 min and has been stabilized by exposure to fluorine using the extruder fluorination procedure of Example 2 of U.S. Pat. No. 6,838,545 (Chapman) except that the fluorine concentration is reduced from 2500 ppm in the '545 Example to 1200 ppm. The foam cell nucleating agent is a mixture of 91.1 wt % boron nitride, 2.5 wt % calcium tetraborate and 6.4 wt % of the barium salt of telomer B sulfonic acid, to total 100% of the combination of these ingredients, as disclosed in U.S. Pat. No. 4,877,815 (Buckmaster et al.). To form a foamable fluoropolymer composition, the fluoropolymer is dry blended with the foam cell nucleating agent to provide a concentration thereof of 0.4 wt % based on the total weight of the fluoropolymer plus foam cell nucleating agent, and then the resultant mixture is compounded in an extruder and extruded as pellets, which are then used in the extrusion wire coating/foaming process. The fluoropolymer used to form the unfoamed regions of the polymer insulation is the same fluoropolymer by itself.

Comparative Example

In this Example, 10 mil (250 μm) thick foamed fluoropolymer insulation is extrusion-formed on 0.0226 in (575 μm) diameter copper wire. This insulation exhibits a capacitance of 48 pF/ft (157 pf/m), which corresponds to a void content of about 24%. Solid fluoropolymer insulation of the same dimension leads to a capacitance of 54 pF/ft (177 pF/m). The cell size of the voids is uniform and less than 50 μm in diameter, determined by placing a thin cross section of the insulation under a microscope and measuring the diameter of 20-30 cells chosen at random, and averaging the result. The mean is the average cell diameter and the cell size is said to be uniform if the coefficient of variation (standard deviation divided by the mean) of the cell diameter is less than about 50%, preferably less than about 25%, and more preferably less than about 15%. In addition to the foamed region of the insulation, the insulation also includes inner and outer unfoamed layers, similar to layers 34 and 36 of FIG. 3, but no spines. Each of these layers is about 1 mil (25 μm) in thickness.

The extrusion conditions to make this polymer-insulated wire are as follows: An extruder having a 45 mm bore and L/D ratio of 30:1 is used. Nitrogen is injected into the molten fluoropolymer composition within the extruder under a pressure of 2800 psig (19 MPa). The extrusion annular orifice is defined by a die tip outer diameter of 0.110 in (2.8 mm) and die inner diameter of 0.180 in (4.6 mm). The die is also modified to have a annular gap (58 in FIG. 7) 0.011 in (0.28 mm) wide to create the outer layer of the insulation. The melt temperature for the fluoropolymer containing the foam cell nucleating agent is 680° F. (360° C.), and the copper wire is heated to 230° F. (110° C.), which chills the molten fluoropolymer composition enough to form the unfoamed inner layer. The draw down ratio (DDR) is about 20 and the line speed is 740 ft/min (226 m/min).

The crush modulus of the resultant foamed fluoropolymer insulation is 13.9 lbf/in (2.43 N/mm).

Example 1

The fluoropolymer insulation in this Example resembles that of FIG. 3 and exhibits a capacitance of about 48 pF/ft, corresponding to a greater void content, i.e. greater number of cells in the foamed region, than for the for the foamed insulation of the Comparative Example, the cell size being uniform and about the same size as the cells in the foamed insulation of the Comparative Example. The average void content of the fluoropolymer insulation in this Example is the same as that of the Comparative Example, as shown by the identical capacitance. The crush modulus for this insulation is 15.7 lbf/in (2.75 N/mm).

This fluoropolymer insulation is made using the extruder conditions disclosed above, except that the die tip includes 5 ports (74 of FIG. 7) each having a constriction at the opening into the annular gap 59 (FIG. 7) to provide the 5 symmetrically disposed splines. The diameter of this constriction is 0.050 in (1.27 mm). Nitrogen pressure is 3100 psig (21.4 MPa). The fluoropolymer fed through the 5 ports to form the spline and outer unfoamed layer is obtained from a side extruder heating the fluoropolymer to a melt temperature of 690° F. (366° C.). The side extruder has a 38 mm bore and L/D ratio of 24:1. The flow rate of molten polymer through the main extruder is about 20 lb/hr (9.1 kg/hr) and through the side extruder about 10 lb/hr (4.5 kg/hr). The line speed is 712 ft/min (217 m/min).

Example 2

The fluoropolymer insulation of this Example resembles that of FIG. 2 except that it has twelve unfoamed regions uniformly spaced around and radially extending within the insulation from the conductor. The average void content of this insulation is 20%. A pair of these polymer-insulated conductors is twinned and the impedance of the twisted pair (twisted pair 1) is measured.

Another foamed fluoropolymer-insulated conductor is prepared which is entirely foamed, i.e., no unfoamed regions are present, this insulation having the same thickness and void content of 20%. A pair of these foamed fluoropolymer-insulated conductors are twinned under the same conditions, and the impedance of this twisted pair (twisted pair 2) is measured.

The impedance of twisted pair 1 is 1.5 ohms greater than for twisted pair 2, revealing the crush resistance provided by the unfoamed regions within the foamed polymer insulation. The void content of the foamed regions of the insulation of twisted pair 1 is greater than the void content of the insulation of twisted pair 2 to compensate for the unfoamed regions present in the insulation of twisted pair 1.

What is claimed is:

1. Twisted pair of polymer insulated conductors, the twisting to form said twisted pair forcing the surface of polymer insulation of each polymer-insulated conductor of said polymer-insulated conductors into contact with one another, the polymer insulation of each said polymer-insulated conductor including (i) a foamed polymer portion being crushable by said forcing said surface of said polymer insulation of said polymer-insulated conductors into contact with one another and (ii) a crush-resistant polymer portion extending radially within said insulation into said foamed polymer portion and being present where said surface of said polymer-insulated conductors are in said contact with one another, thereby protecting said foamed polymer portion from crushing resulting from said forcing said surface of said polymer insulation of said polymer-insulated conductors into contact with one another.

2. The twisted pair of polymer-insulated conductors of claim 1 wherein said crush resistant portion is essentially unfoamed polymer.

3. The twisted pair of polymer-insulated conductors of claim 1 wherein said crush-resistant polymer portion extends through at least 60% of the thickness of said foamed portion.

4. The twisted pair of polymer-insulated conductors of claim 1 wherein said crush-resistant polymer portion has an inwardly tapering cross-section extending radially into said foamed polymer portion.

5. The twisted pair of polymer-insulated conductors of claim 1 wherein polymer insulation is about 4 to 20 mil thick.

6. The twisted pair of polymer-insulated conductors of claim 1 wherein the average void content of said polymer insulation is about 10 to 70%.

7. The twisted pair of polymer-insulated conductors of claim 1 wherein the crush resistance of said crush-resistant polymer portion is such that the width of said twisted pair is at least about 90% of the sum of the diameters of each said polymer-insulated conductors prior to said twisting.

8. The twisted pair of polymer-insulated conductors of claim 1 wherein said portions (i) and (ii) constitute the entire said polymer insulation.

9. The twisted pair of polymer-insulated conductors of claim 1 wherein said portions (i) and (ii) are each subdivided into at least three regions alternating with respect to one another and extending along the length of each said polymer-insulated conductors.

10. The twisted pair of polymer-insulated conductors of claim 9 wherein said portion (ii) includes a layer of essentially unfoamed polymer interconnecting said at least three regions of said portion (ii) at said surface of said polymer insulation of each said polymer-insulated conductors.

11. The twisted pair of polymer-insulated conductors of claim 9 wherein said portion (ii) includes a layer of essentially unfoamed polymer interconnecting said at least three regions of portion (ii) at the surface of said conductor.

12. The twisted pair of polymer-insulated conductors of claim 9 wherein said polymer of said polymer insulation is selected from the group consisting of fluoropolymer and polyolefin.

13. The twisted pair of insulated conductors of claim 9 wherein said portions (i) and (ii) are subdivided into at least five regions.

14. The twisted pair of insulated conductors of claim 9 wherein said portions (ii) extend essentially through the entire thickness of said insulation.

* * * * *